US007558491B2

(12) United States Patent
Park

(10) Patent No.: US 7,558,491 B2
(45) Date of Patent: Jul. 7, 2009

(54) ELECTRO-PHOTOGRAPHIC IMAGE FORMING APPARATUS HAVING ONE OR MORE SAFETY SENSORS INSTALLED TO IMPROVE USER SAFETY

(75) Inventor: Kwang-sung Park, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 427 days.

(21) Appl. No.: 11/432,417

(22) Filed: May 12, 2006

(65) Prior Publication Data

US 2006/0269298 A1 Nov. 30, 2006

(30) Foreign Application Priority Data

May 31, 2005 (KR) ..... 10-2005-0046086

(51) Int. Cl.
*G03G 15/00* (2006.01)

(52) U.S. Cl. ..... 399/16; 399/21

(58) Field of Classification Search ..... 399/9, 399/11, 31, 33, 16, 18, 21
See application file for complete search history.

(56) References Cited

U.S. PATENT DOCUMENTS

| | | | | | |
|---|---|---|---|---|---|
| 3,734,604 | A | * | 5/1973 | Szostak et al. | 399/33 |
| 3,970,384 | A | * | 7/1976 | Yamamoto et al. | 399/21 |
| 4,967,234 | A | * | 10/1990 | Tani et al. | 399/13 |
| 5,978,621 | A | * | 11/1999 | Glemser et al. | 399/90 |
| 6,259,867 | B1 | | 7/2001 | Park et al. | |
| 7,003,244 | B2 | * | 2/2006 | Cho | 399/110 |

FOREIGN PATENT DOCUMENTS

| | | | | |
|---|---|---|---|---|
| CN | 1526619 | A | | 9/2004 |
| EP | 1 500 955 | | | 1/2005 |
| JP | 62146877 | A | * | 6/1987 |
| JP | 01209244 | A | * | 8/1989 |
| JP | 04191782 | A | * | 7/1992 |
| JP | 04315141 | A | * | 11/1992 |
| JP | 09258617 | A | * | 10/1997 |
| JP | 11-138947 | | | 5/1999 |
| JP | 11227983 | A | * | 8/1999 |
| JP | 2000-159360 | | | 6/2000 |
| JP | 2001-322723 | | | 11/2001 |
| KR | 2000-65854 | | | 11/2000 |
| KR | 2001-47490 | | | 6/2001 |
| KR | 2001-47496 | | | 6/2001 |

OTHER PUBLICATIONS

Office Action issued in Korean Patent Application No. 2005-46086 on May 25, 2006.
Office Action issued in Chinese Patent No. 2006100876603 on May 9, 2006.

* cited by examiner

*Primary Examiner*—Robert Beatty
(74) *Attorney, Agent, or Firm*—Stein McEwen, LLP

(57) ABSTRACT

An image forming apparatus having a safety sensor. At least one safety sensor is mounted on an inner wall of the main body to detect an object entering a space in the main body, other than a space corresponding to a normal moving path of the printing medium. A control unit controls an image formation unit in response to a signal from the safety sensor, to establish a safe condition within the main body.

27 Claims, 5 Drawing Sheets

ELECTRO-PHOTOGRAPHIC IMAGE FORMING APPARATUS HAVING ONE OR MORE SAFETY SENSORS INSTALLED TO IMPROVE USER SAFETY

CROSS-REFERENCE TO RELATED APPLICATIONS

This application claims benefit of Korean Patent Application No. 2005-46086, filed May 31, 2005, the Korean Intellectual Property Office, the disclosure of which is incorporated herein by reference.

BACKGROUND OF THE INVENTION

1. Field of the Invention

An aspect of the present invention relates to an image forming apparatus and more particularly, to an image forming apparatus having a safety sensor.

2. Description of the Related Art

Generally, an image forming apparatus, such as a copier or a laser printer, performs printing by producing an image using a laser beam and fixing the image onto a printing medium.

In FIG. 1, a conventional image forming apparatus 1 comprises a main body 10, a paper feeding unit 20, a laser scan unit 30, a developing unit 40, a transfer roller 50, a fixing unit 60, and a discharge unit 70.

The main body 10 supports arrangement and operation of the other component parts such as the paper feeding unit 20, the laser scan unit 30, the developing unit 40, the transfer roller 50, the fixing unit 60, and the discharge unit 70.

The paper feeding unit 20 stores predetermined sheets of a printing medium and supplies the printing medium sheet by sheet. The paper feeding unit 20 comprises a paper supply cassette 21 and a pickup roller 22. The laser scan unit 30 projects a laser beam according to printing data onto a photoconductive drum 41, thereby generating an electrostatic latent image. The developing unit 40 comprises the photoconductive drum 41 on which the electrostatic latent image is generated, a developing roller 42 developing the electrostatic latent image by supplying toner, and a toner hopper 43 storing a predetermined amount of the toner. The transfer roller 50 rotates in contact with the photoconductive drum 41 to transfer the image formed on the photoconductive drum 41 to the printing medium. The fixing unit 60 fixes the image as transferred to the printing medium by heat and pressure. The fixing unit 60 comprises a pressing roller 61 and a heating roller 62. The discharge unit 70 includes a discharging roller 71 to eject the printing medium on which image fixation is completed toward a discharge tray 73 formed outside of the main body 10.

As described above, the image forming apparatus 1 forms the electrostatic latent image on the photoconductive drum 41 by projecting the laser beam from the laser scan unit 30 and fixes the image by applying heat and pressure through the fixing unit 60. Herein, however, direct exposure to the laser beam and the heat and pressure may be harmful for a user. Therefore, the image forming apparatus 1 is required to prevent access of the user to a laser beam path or to the fixing unit. Conventionally, for this purpose, an entrance and a moving path of the printing medium is so narrowly formed that the user cannot access them, or mechanical protectors are mounted to all the operational paths where the user may access.

However, when the entrance and the moving path for the printing medium are too narrow, accessibility of the user is deteriorated in the case that the image forming apparatus 1 encounters trouble. For example, when a paper jam is generated, it is difficult for the user to remove the jammed printing medium.

Furthermore, when the mechanical protectors are provided to all the necessary parts, the manufacturing cost increases and compactness of the image forming apparatus 1 is lost.

SUMMARY OF THE INVENTION

An aspect of the present invention is to solve the above and/or other problems and/or disadvantages and to provide at least the advantages described below. Accordingly, an aspect of the present invention is to provide an image forming apparatus which simultaneously improves safety and accessibility for a user.

Another aspect of the present invention is to provide an image forming apparatus capable of improving user safety and compactness thereof at the same time.

In order to achieve the above-described aspects of the present invention, there is provided an image forming apparatus comprising a main body; a paper feeding unit mounted to the main body to stack and supply printing medium; an image formation unit disposed above the paper feeding unit to produce a predetermined image on the printing medium supplied from the paper feeding unit; at least one safety sensor mounted on an inner wall of the main body to detect an object entering a space in the main body, the space other than a normal moving path of the printing medium; and a control unit controlling the image formation unit according to a signal from the safety sensor.

The safety sensor comprises a transmission part and a reception part mounted on opposite inner walls of the main body, respectively. The safety sensor may use a light or an ultrasonic wave in detecting the object.

When the safety sensor detects the object, the control unit stops the operation of the image formation unit or cuts off power supply to the image formation unit.

According to another aspect of the present invention, there is provided an image forming apparatus comprising a main body; a paper feeding unit mounted to the main body to stack and supply printing medium; a photoconductive drum disposed at an upper part of the paper feeding unit to transfer a predetermined image onto a printing medium supplied from the paper feeding unit; a laser scan unit mounted at one side of the photoconductive drum to project a laser beam to the photoconductive drum; a fixing unit disposed at an upper part of the photoconductive drum to fix the transferred image onto the printing medium; at least one first safety sensor mounted on an inner wall of the main body at an upper part of the paper feeding unit to detect an object getting deviated from a normal moving path of the printing medium; and a control unit controlling operations of the laser scan unit and the fixing unit according to a signal from the first safety sensor.

The image forming apparatus further comprises at least one second safety sensor disposed between the photoconductive drum and the laser scan unit to detect an object getting into a space between the photoconductive drum and the laser scan unit, and at least one third safety sensor mounted at a location other than the normal moving path of the printing medium being passed through the fixing unit to detect an object getting into the fixing unit. The control unit controls an operation of the laser scan unit or the fixing unit according to signals from the second and the third safety sensors, respectively.

The first, the second, and the third safety sensors each comprise a transmission part and a reception part mounted on opposite inner walls of the main body. The image forming apparatus may further comprise a display unit to show operation states of the safety sensors. Also, a plurality of the first safety sensors may be linearly arranged.

As described above, the image forming apparatus capable of stopping by a safety sensor the operation upon detection of an object getting into the main body, according to an embodiment of the present invention, enables the user to safely access the entrance and the moving path for the printing medium.

In addition, in the image forming apparatus according to an embodiment of the present invention, the safety sensor also detects the printing medium deviating from its normal path, thereby finding out in advance and coping with multiple feeding of the printing medium or paper jam.

Also, since the image forming apparatus according to an embodiment of the present invention does not require the mechanical protectors for blocking the user's access to the laser scan unit and the fixing unit, the manufacturing cost can be saved and the image forming apparatus can be in a compact size.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
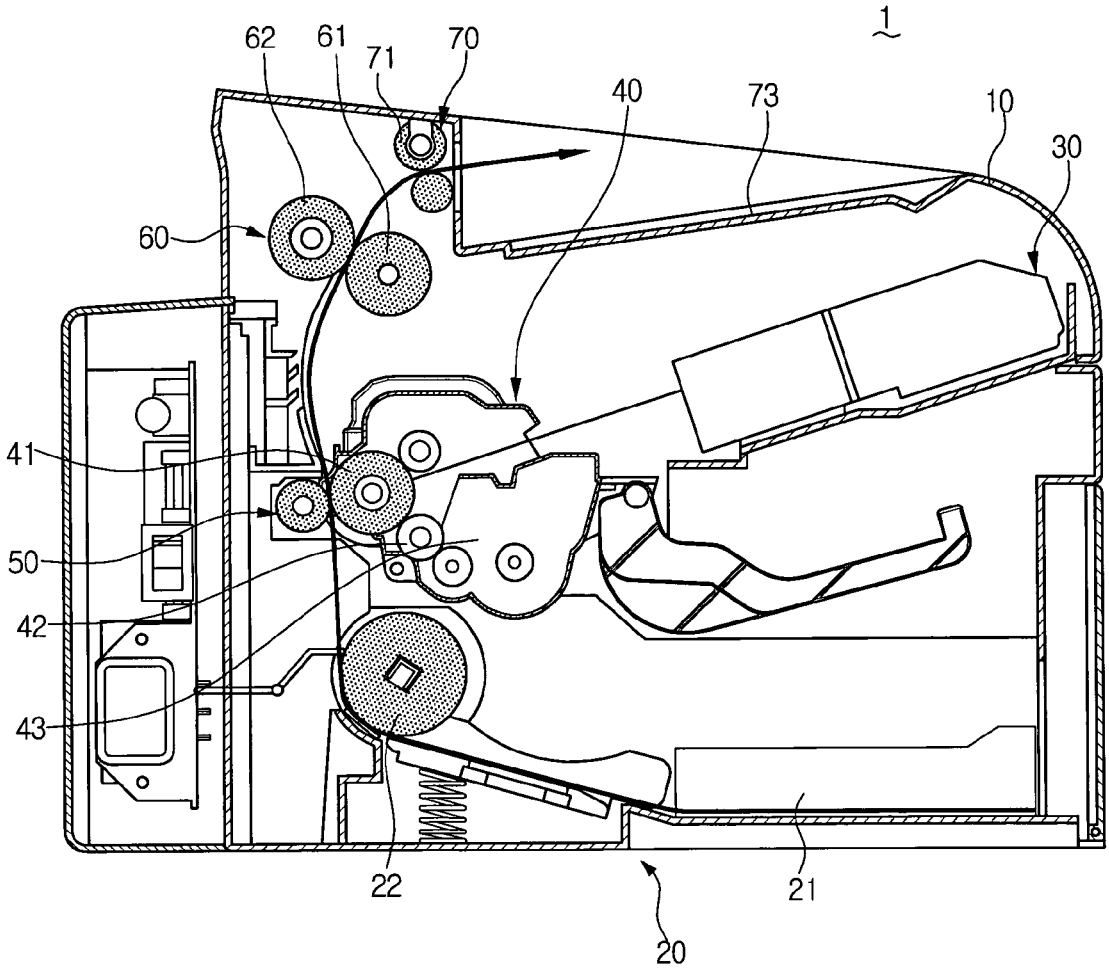
FIG. 1 (PRIOR ART)
FIG. 1 is a sectional view of a conventional image forming apparatus.

Reference will now be made in detail to the present embodiments of the present invention, examples of which are illustrated in the accompanying drawings, wherein like reference numerals refer to the like elements throughout. The embodiments are described below in order to explain the present invention by referring to the figures. The detailed construction and elements are provided to assist in an understanding of the invention. Well-known functions or constructions are not described in detail since they would obscure the invention with unnecessary detail.

Figure 2:
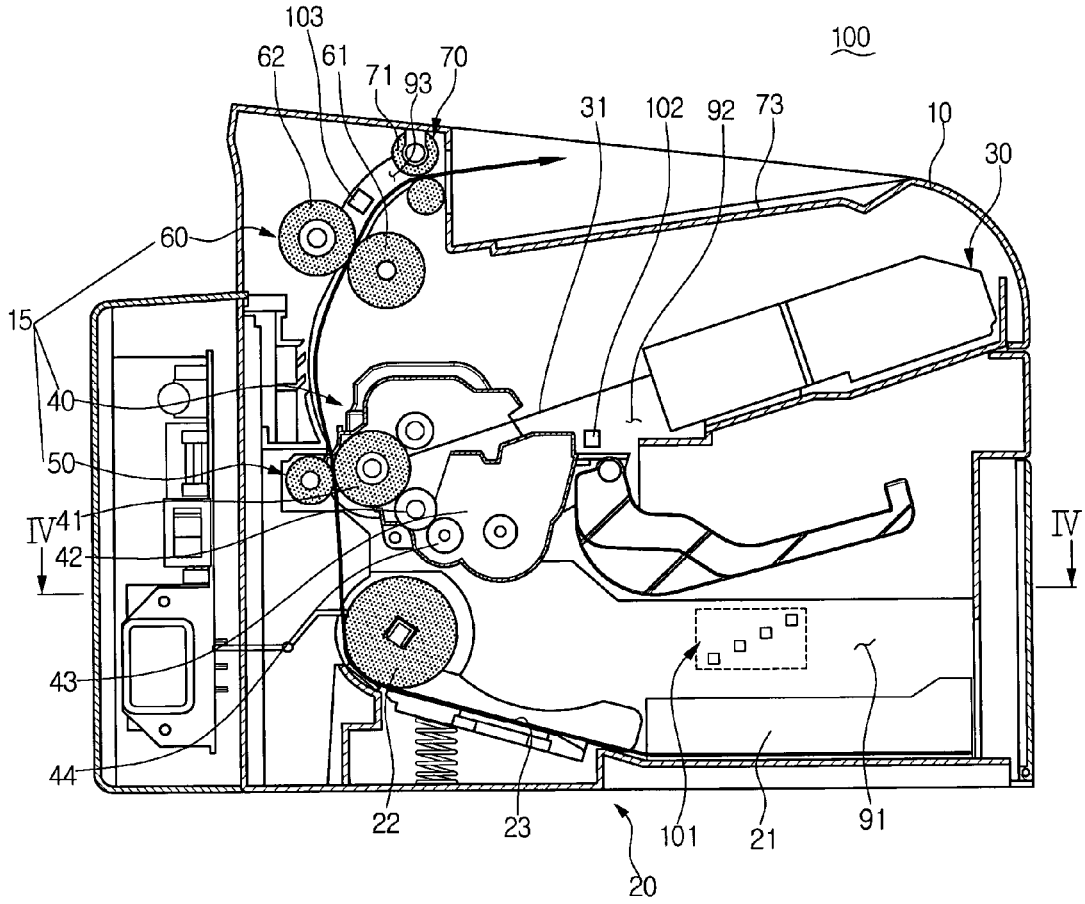
FIG. 2 is a sectional view of an image forming apparatus according to an embodiment of the present invention.
Figure 3:
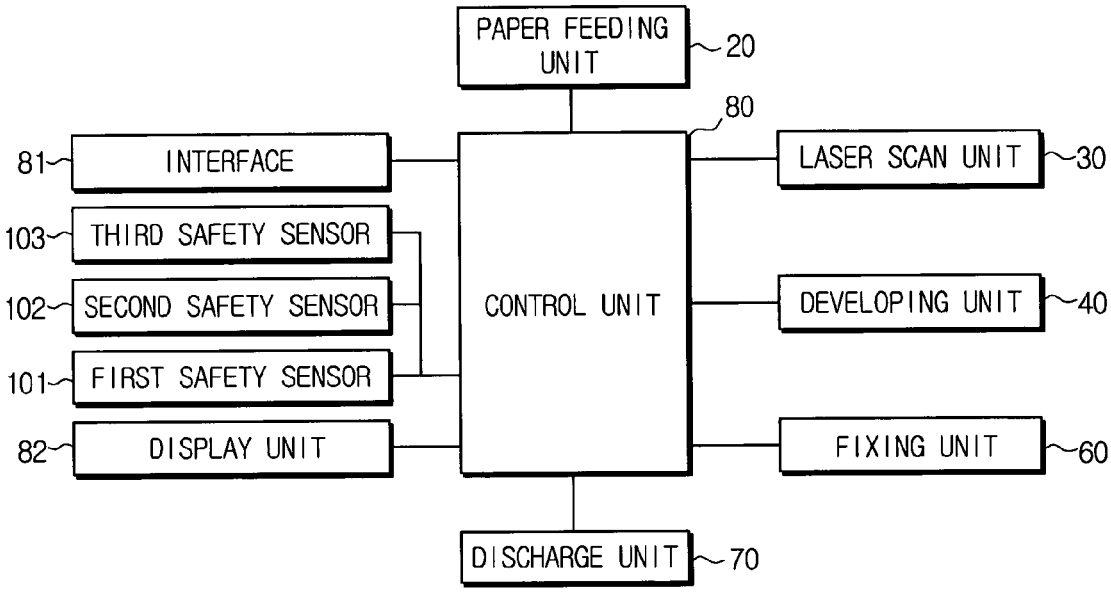
FIG. 3 is a block diagram illustrating operation of the image forming apparatus shown in FIG. 2.

Referring to FIGS. 2 and 3, an image forming apparatus 100 according to an embodiment of the present invention comprises a main body 10, a paper feeding unit 20, an image formation unit 15, a discharge unit 70, a plurality of safety sensors 101, 102, and 103, and a control unit 80.

The main body 10 supports arrangement and operation of the other component parts such as the paper feeding unit 20, the image formation unit 15, the discharge unit 70, the safety sensors 101, 102, and 103, and the control unit 80. Also, a power supply (not shown) for delivering electric power to the component parts of the image forming apparatus 100 is mounted in the main body 10.

The paper feeding unit 20 stores predetermined sheets of printing medium 23 and supplies the printing medium 32 sheet by sheet. The paper feeding unit 20 comprises a paper supply cassette 21 and a pickup roller 21. The paper supply cassette 21, being removably mounted to a lower part of the main body 10, contains predetermined sheets of the printing medium 23. The pickup roller 22 is disposed above a front end of the paper supply cassette 21 to pick up and move the printing medium 23 stacked in the paper supply cassette 21 to a transfer roller 50 sheet by sheet.

The image formation unit 15 produces an image according to printing data and transfers the image onto the printing medium 23 fed from the paper feeding unit 20. The image formation unit 15 comprises a laser scan unit 30, a developing unit 40, a transfer roller 50, and a fixing unit 60.

The laser scan unit 30 forms an electrostatic latent image on a photoconductive drum 41 by projecting a laser beam 31 corresponding to the printing data. The developing unit 40 comprises the photoconductive drum 41 on which the electrostatic latent image is generated, a developing roller 42 developing the electrostatic latent image to a visible image by toner, a toner hopper 43 storing a predetermined amount of the toner and supplying the toner to the developing roller 42, and a housing 44 supporting the above component parts of the developing unit 40. The transfer roller 50 rotates in contact with the photoconductive drum 41 so as to transfer the image formed on the photoconductive drum 41 to the printing medium 23. The fixing unit 60 fixes the image as transferred to the printing medium 23 by heat and pressure. The fixing unit 60 comprises a pressing roller 61 and a heating roller 62.

Since operation and structure of the respective parts 30, 40, 50 and 60 constituting the image formation unit 15 are the same as those of the conventional art, a detailed description thereof will be not be repeated. In addition, the structure of the image formation unit 15 as described above is only by way of example. The invention is useful in combination with image forming units having other structures.

The discharge unit 70 includes a discharging roller 71 to eject the printing medium 23 where image fixation is completed, to a discharge tray 73 formed outside the main body 10.

The safety sensors 101, 102 and 103 detect any object entering the main body 10 through spaces other than the moving path of the printing medium 23. Upon detecting the object, the safety sensors 101, 102 and 103 correspondingly transmit a signal to the control unit 80. The object herein comprises anything that may enter the main body 10, for example, a user's hand or a stick inserted by the user. In order to detect the object encountering the path for the laser beam 31 or to the fixing unit 60, intentionally or by mistake, the safety sensors 101, 102 and 103 are disposed within the main body 10.

FIG. 2 shows an image forming apparatus 100 according to an embodiment of the present invention, where three safety sensors 101, 102 and 103 are provided at three different locations. A number and location of the safety sensors may vary according to an inner construction of the image forming apparatus 100.

In the embodiment illustrated in FIG. 2, the first safety sensor 101 is disposed at a first space 91 formed between the paper feeding unit 20 and the developing unit 40. The first safety sensor 101 is disposed on inner walls 11 and 12 (See FIG. 4) of the main body 10 so as not to operate when the printing medium 23 is normally picked up by the paper feeding unit 20 and fed but to react to an object entering the first space 91 disposed at an upper part of the paper feeding unit 20. The first safety sensor 101 comprises a transmission part 101*a* and a reception part 101*b* (See FIG. 5). The transmission part 101*a* is disposed on one inner wall 11 of the main body 10 while the reception part 101*b* on another inner wall 12. The transmission part 101*a* emits a light or an ultrasonic wave and the reception part 101*b* receives the light or the ultrasonic wave, respectively, from the transmission part 101*a*. Therefore, if any object passes between the transmission part 101*a* and the reception part 101*b* , the light or the ultrasonic wave would not reach the reception part 101*b* , thereby detecting entry of the object. According to types of the safety sensor 101, a light, a laser beam, or an ultrasonic wave may be used for detection of the object.

Figure 6A:
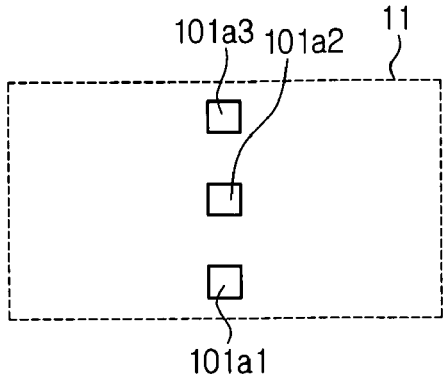
FIGS. 6A, 6B and 6C illustrate various arrangements of a plurality of the first safety sensors in the image forming apparatus according to an embodiment of the present invention.
Figure 6B:
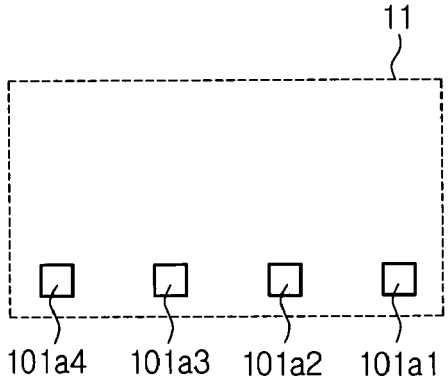
Figure 6C:
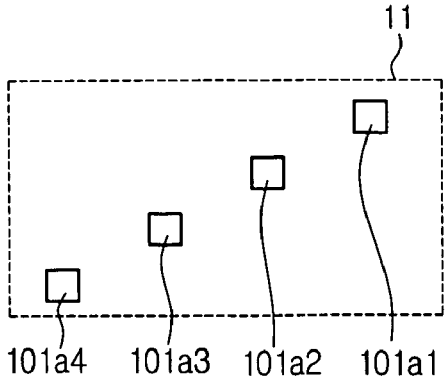

The number and arrangement of the first safety sensor 101 may be varied according to a volume of the first space 91. FIGS. 6A through 6C show various arrangements of transmission parts 101 a of a plurality of the first safety sensors 101, being linearly arranged on the inner wall 11. Although not shown, a plurality of the reception parts 101*b* are disposed on the opposite inner wall 12 corresponding to the transmission parts 101*b*. In FIG. 6A, three first transmission parts 101*a*1, 101*a*2, and 101*a*3 of the first safety sensor 101 are linearly arranged in a vertical direction with respect to the paper supply cassette 21 on the inner wall 11. In FIG. 6B, four transmission parts 101*a*1, 101*a*2, 101*a*3, and 101*a*4 of the first safety sensor 101 are linearly arranged in a horizontal direction with respect to the paper supply cassette 21. FIG. 6C shows four transmission parts 101*a*1, 101*a*2, 101*a*3, and 101*a*4 being linearly arranged in a diagonal direction with respect to the paper supply cassette 21. Although not illustrated, the plurality of first transmission parts 101*a*1, 101*a*2, 101*a*3, and 101*a*4 may be arranged in other various ways. Additionally, the first transmission parts 101*a*1, 101*a*2, 101*a*3, and 101*a*4 can be equipped to detect paper jam occurring in the paper feeding unit 20.

The second safety sensor 102 is disposed to detect the object entering a second space 92 between the developing unit 40 and the laser scan unit 30, where the laser beam 31 passes by. Since there is the first space 91 below the moving path of the laser beam 31, the object entering the second space 92 through the first space 91 needs to be detected by the second safety sensor 102. Although one second safety sensor 102 is employed in the embodiment shown in FIG. 2, a number of the second safety sensor 102 may be varied according to volume of the second space 92. In case of using a plurality of the second safety sensors 102, the arrangement thereof is similar with the arrangement of the first safety sensors 101.

Referring now to FIG. 3, the control unit 80, being disposed within the main body 10, receives a printing command and printing data from a computer (not shown) through an interface 81 and controls the paper feeding unit 20, the laser scan unit 30, the developing unit 40, the transfer roller 50 (FIG. 2), the fixing unit 60 and the discharge unit 70, thereby performing the printing work. Since the controlling principle of the control unit 80 for printing is the same as in the conventional art, the printing function will not be described in detail. The control unit 80 further controls the printing operation in response to signals from the first to the third sensors 101, 102, and 103. For example, as an object-detection signal is input from the first safety sensor 101, the control unit 80 stops the operation of the laser scan unit 30 and the fixing unit 60 or cuts off power supply to the laser scan unit 30 and the fixing unit 60. When the second safety sensor 102 outputs the object-detection signal, the control unit 80 stops the operation of the laser scan unit 30 or cuts off power supply to the laser scan unit 30. However, the stoppage of the laser scan unit 30 and the fixing unit 60 according to the signals from the first to the third safety sensors 101, 102 and 103 is only an exemplary operation of the control unit 80. Therefore, as long as the purpose is to protect the user from the laser beam and the heat and pressure, the control unit 80 may stop the overall operation or power supply to the image forming apparatus 100.

Moreover, the control unit 80 may output which of the first, second and third safety sensors 101, 102, and 103, respectively, is/are in operation through a display unit 82 such as a liquid crystal display (LCD) provided on the outside of the main body 10, so that the user can be informed of the operation state of the safety sensors 101, 102, and 103.

When the object detected by one of the first to the third safety sensors 101, 102, and 103 is removed and the safety sensors 101, 102, and 103 outputs a normal signal, the control unit 80 recovers the stopped operation of the component parts such as the laser scan unit 30 or the fixing unit 60 and continues the printing work.

Operation of the image forming apparatus 100 according to an embodiment of the present invention will be described in greater detail with reference to the accompanying drawings.

Upon receiving the printing command, the control unit 80 controls the laser scan unit 30 to project the laser beam 31 corresponding to the printing data. The photoconductive drum 41 is formed with an electrostatic latent image corresponding to the printing data by the laser beam 31. The developing roller 42 supplies the toner from the toner hopper 43 to develop the electrostatic latent image into a visible image. The visible image is moved to the transfer roller 50 by rotation of the photoconductive drum 41 and herein, the printing medium 23 is fed from the paper feeding unit 20 between the photoconductive drum 41 and the transfer roller 50. Accordingly, the visible image formed on the photoconductive drum 41 is transferred onto the printing medium 23 by the transfer roller 50. The printing medium 23 bearing the transferred image thereon is fed to the fixing unit 60 to pass through the pressing roller 61 and the heating roller 62. Therefore, the transferred image is fixed on the printing medium 23 by the heat and pressure. Finally, the printing medium 23 bearing the fixed image thereon is discharged by the discharge unit 70 to the discharge tray 73 formed at the outside of the main body 10.

Figure 4:
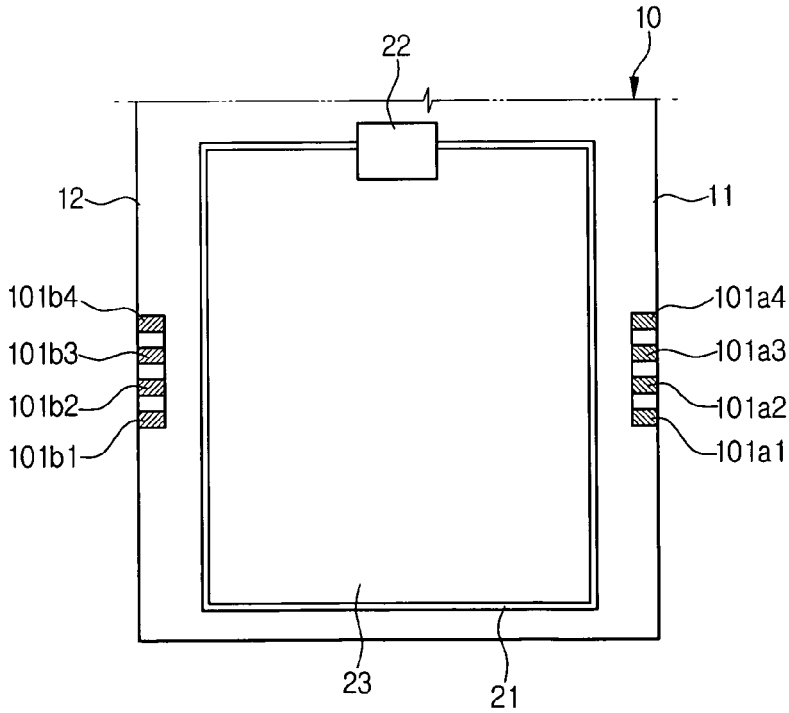
FIG. 4 is a sectional view of FIG. 2 taken along a line IV-IV in FIG. 2.
Figure 5:
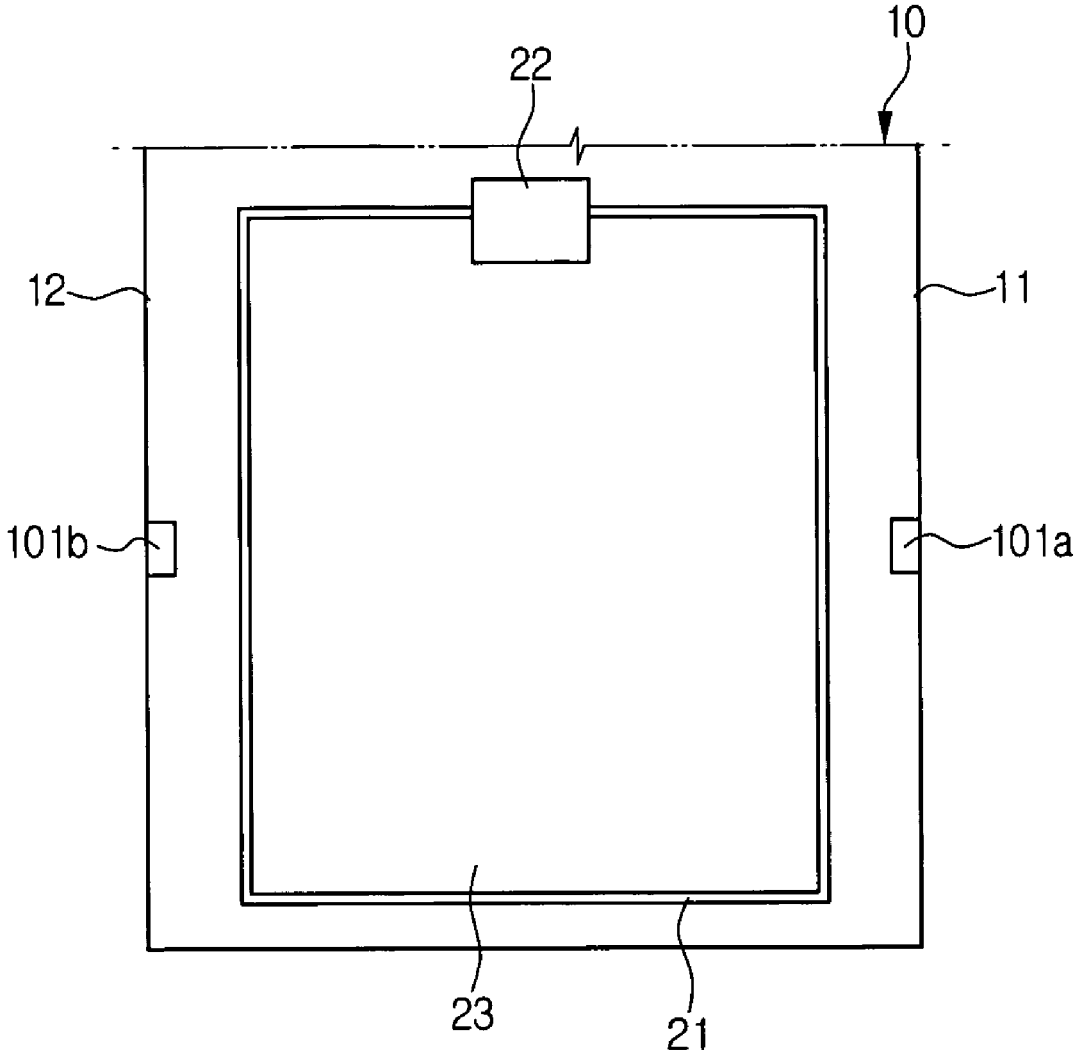
FIG. 5 is a sectional view of FIG. 4 where a first safety sensor is installed.

If an object gets into the first space 91 during the printing work of the image forming apparatus 100, the light transmitted from the transmission part 101 a of the first safety sensor 101 cannot reach the reception part 101*b*. Therefore, the first safety sensor 101 outputs the object-detection signal and according to this, the control unit 80 recognizing entry of the object into the first space 91 stops the operations of the laser scan unit 30 and the fixing unit 60. In case that the control unit 80 is designed to cut off power supply to the laser scan unit 30 and the fixing unit 60, the power supply to the laser scan unit 30 and the fixing unit 60 is stopped. In case that four first safety sensors 101 are provided as shown in FIG. 4, the control unit 80 operates in the same way upon detection by even one of the four reception parts 101*b*1, 101*b*2, 101*b*3, and 101*b*4 of the first safety sensor.

When the object gets into the second space 92, the second safety sensor 102 detects this through interception of the light and outputs the object-detection signal to the control unit 80. Therefore, the control unit 80 recognizing entry of the object stops the operation of the laser scan unit 30 or cuts off power supply to the laser scan unit 30.

In addition, if the object enters the fixing unit 60 through the discharge unit 70 during the printing work, the third safety sensor 103 detects this and outputs the object-detection signal to the control unit 80. Then, the control unit 80 recognizes entry of the object to the fixing unit 60 and in response, stops the operation of the fixing unit 60 or cuts off power supply to the fixing unit 60.

As described above, although an object, such as a user's hand enters the main body 10, the control unit 80 detects this entry through the first, second and third safety sensors 101, 102, and 103 and controls the laser scan unit 30 and the fixing unit 60 to stop the operation. Consequently, the user can be protected from dangerous factors such as the laser beam or the heat and pressure.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a main body;

a paper feeding unit mounted to the main body, to supply a printable medium;

an image formation unit disposed above the paper feeding unit, to form an image on the printable medium supplied from the paper feeding unit along a normal moving path;

a safety sensor mounted on an inner wall of the main body, to detect an object entering a space in the main body, the space being other than the normal moving path of the printable medium; and a control unit arranged to control the image formation unit according to a signal from the safety sensor, wherein the image forming unit comprises a developing unit disposed adjacent the paper feeding unit, and wherein the safety sensor is disposed in a space between the paper feeding unit and the developing unit.

2. The image forming apparatus of claim 1, wherein the safety sensor comprises a transmission part and a reception part mounted on opposite inner walls of the main body, respectively.

3. The image forming apparatus of claim 2, wherein the safety sensor uses a light or an ultrasonic wave in detecting the object.

4. The image forming apparatus of claim 1, wherein, when the safety sensor detects the object, the control unit stops an operation of the image formation unit or cuts off power supply to the image formation unit.

5. The image forming apparatus of claim 1, wherein the safety sensor comprises a plurality of transmission parts installed at one side of the space between the paper feeding unit and the developing unit to transmit a light or an ultrasonic wave, and a plurality of reception parts installed at another side of the space between the paper feeding unit and the developing unit to receive the light or the ultrasonic wave so as to detect the object entering the space.

6. The image forming apparatus of claim 1, wherein:

the image forming unit comprises a laser scan unit and a developing unit including a photosensitive drum;

the safety sensor comprises a plurality of mutually transmission parts and a corresponding plurality of reception parts; and the transmission parts and the reception parts are arranged along respective lines between the laser scan unit and the photosensitive drum.

7. An image forming apparatus comprising:

a main body;

a paper feeding unit mounted to the main body to supply a printable medium;

a photoconductive drum disposed above the paper feeding unit to form an image onto the printable medium supplied from the paper feeding unit;

a laser scan unit mounted at one side of the photoconductive drum to project a laser beam to the photoconductive drum;

a fixing unit disposed above the photoconductive drum to fix the image formed onto the printable medium;

a first safety sensor mounted on an inner wall of the main body, and disposed above the paper feeding unit to detect an object deviating from a normal moving path of the printable medium;

a second safety sensor disposed between the photoconductive drum and the laser scan unit to detect an object entering a space between the photoconductive drum and the laser scan unit, and a control unit arranged to control operations of the laser scan unit and the fixing unit according to a signal from one of the first safety sensor and the second safety sensor.

8. The image forming apparatus of claim 7, wherein the first safety sensor comprises one or more transmission parts installed above the paper feeding unit at one side of the printable medium to transmit a light or an ultrasonic wave, and one or more reception parts installed above the paper feeding unit at another side of the printable medium to receive the light or the ultrasonic wave so as to detect the object.

9. The image forming apparatus of claim 7, further comprising a third safety sensor mounted at a location other than the normal moving path of the printable medium being passed through the fixing unit to detect an object getting into the fixing unit, and wherein the control unit controls an operation of the fixing unit according to a signal from the third safety sensor.

10. The image forming apparatus of claim 7, wherein the first safety sensor further comprises a transmission part and a reception part mounted on opposite inner walls of the main body above the paper feeding unit.

11. The image forming apparatus of claim 7, wherein, when the first safety sensor detects the object, the control unit stops the operations of the laser scan unit and the fixing unit or cuts off power supply to the laser scan unit and the fixing unit.

12. The image forming apparatus of claim 11, further comprising a display unit to show an operation state of the first safety sensor.

13. The image forming apparatus of claim 7, wherein the first safety sensor comprises a plurality of transmission parts linearly installed above the paper feeding unit at one side of the printable medium to transmit a light or an ultrasonic wave, and one or more reception parts installed above the paper feeding unit at another side of the printable medium to receive the light or the ultrasonic wave so as to detect the object.

14. The image forming apparatus of claim 8, further comprising a third safety sensor mounted at a location other than the normal moving path of the printable medium being passed through the fixing unit to detect an object getting into the fixing unit, and wherein the control unit controls an operation of the fixing unit according to a signal from the third safety sensor.

15. The image forming apparatus of claim 14, further comprising a display unit to show an operation state of the first, second and third safety sensors.

16. The image forming apparatus of claim 8, further comprising a display unit to show an operation state of the first and second safety sensors.

17. An image forming apparatus, comprising:

a main body;

a paper feeding unit mounted to the main body to supply a printable medium;

an image formation unit disposed inside the main body above the paper feeding unit to form an image on the printable medium supplied from the paper feeding unit along a moving path;

a safety sensor mounted on an inner wall of the main body to detect an object entering a space in the main body, the space being outside of the moving path of the printable medium; and a control unit arranged to control the image formation unit according to a signal from the safety sensor, wherein:

the image forming unit comprises a developing unit disposed adjacent the paper feeding unit;

the paper feeding unit comprises a paper cassette to store the printable medium;

the safety sensor comprises a plurality of mutually transmission parts and a corresponding plurality of reception parts; and the transmission parts and the reception parts are arranged along respective lines between the paper cassette and the developing unit.

18. The image forming apparatus of claim 17 wherein the respective lines are vertical with respect to the paper cassette.

19. The image forming apparatus of claim 17, wherein the respective lines are horizontal with respect to the paper cassette.

20. The image forming apparatus of claim 17, wherein the respective lines are diagonal with respect to the paper cassette.

21. A safety system for an image forming apparatus comprising a paper cassette to supply a paper along a designated path, a developing unit to form an image onto the paper from a latent image formed on a photosensitive drum as the paper passes along the designated path, a laser scanning unit to scan a laser beam onto the photosensitive drum for forming the latent image, and a fixing unit to fix the image developed on the paper for discharge, via a discharge unit, the safety system comprising:

a first safety sensor installed above the paper feeding unit to detect paper jam occurring in the paper cassette or an object entering a space other than the designated path of the paper;

a second safety sensor installed to detect an object entering a space between the photosensitive drum and the laser scanning unit;

a third safety sensor installed to detect an object entering a space between the photosensitive drum and the discharge unit; and a controller arranged to control operations of the laser scanning unit and the fixing unit in response to a control signal from one of the first safety sensor, the second safety sensor, and the third safety sensor, wherein the first safety sensor comprises one or more transmitting parts installed to transmit a light or an ultrasonic wave and one or more receiving parts installed to receive the light or the ultrasonic wave, and generate the control signal when the object.

22. The safety system of claim 21, wherein the first safety sensor comprises one or more transmission parts installed above the paper cassette at one side of the paper to transmit a light or an ultrasonic wave, and one or more reception parts installed above the paper cassette at another side of the paper to receive the light or the ultrasonic wave so as to detect the object entering the space other than the designated path of the paper.

23. The safety system of claim 21, wherein the first safety sensor comprises a plurality of transmission parts installed along respective lines above the paper cassette at one side of the paper to transmit a light or an ultrasonic wave, and one or more reception parts installed above the paper cassette at another side of the paper to receive the light or the ultrasonic wave so as to detect the object.

24. The safety system of claim 23, wherein the respective lines are vertical with respect to the paper cassette.

25. The safety system of claim 23, wherein the respective lines are horizontal with respect to the paper cassette.

26. The safety system of claim 21, further comprising:

a display unit to provide a visual indication to a user that the control signal has been generated from one of the first safety sensor, the second safety sensor, and the third safety sensor.

27. The safety system of claim 21, wherein the controller turns off power supply to the laser scanning unit and the fixing unit in response to the control signal.

* * * * *